US008434171B2

(12) United States Patent
Wang

(10) Patent No.: US 8,434,171 B2
(45) Date of Patent: May 7, 2013

(54) COMMODE SEAT FOR A ROLLATOR

(75) Inventor: Lesli Jenkins Wang, Santa Clara, CA (US)

(73) Assignee: Free 2 Go Producs, Santa Clara, CA (US)

( * ) Notice: Subject to any disclaimer, the term of this patent is extended or adjusted under 35 U.S.C. 154(b) by 0 days.

(21) Appl. No.: 13/263,614

(22) PCT Filed: Apr. 5, 2010

(86) PCT No.: PCT/US2010/029926
§ 371 (c)(1),
(2), (4) Date: Oct. 7, 2011

(87) PCT Pub. No.: WO2010/117933
PCT Pub. Date: Oct. 14, 2010

(65) Prior Publication Data

US 2012/0030867 A1 Feb. 9, 2012

Related U.S. Application Data

(60) Provisional application No. 61/168,065, filed on Apr. 9, 2009.

(51) Int. Cl.
*A47K 13/00* (2006.01)

(52) U.S. Cl.
USPC ..... 4/237

(58) Field of Classification Search ..... 4/237–241
See application file for complete search history.

(56) References Cited

U.S. PATENT DOCUMENTS

| | | | | | |
|---|---|---|---|---|---|
| 159,976 | A | * | 2/1875 | Steinbach | 4/483 |
| 3,038,174 | A | * | 6/1962 | Brown et al. | 5/611 |
| 3,193,845 | A | * | 7/1965 | Funk | 4/300.3 |
| 3,271,785 | A | * | 9/1966 | Du Bose | 4/480 |
| 3,611,457 | A | * | 10/1971 | Wippich | |
| 4,060,859 | A | * | 12/1977 | Anderson | 4/307 |
| 4,133,062 | A | * | 1/1979 | Fulbright, Jr. | 4/246.1 |
| 4,348,775 | A | * | 9/1982 | Haslbeck | 2/452 |
| 4,348,776 | A | * | 9/1982 | Sarjeant | 4/300.3 |
| 5,161,812 | A | * | 11/1992 | DeWeese | 280/47.38 |
| 5,276,925 | A | * | 1/1994 | Blaha | 4/300.3 |
| 5,373,591 | A | * | 12/1994 | Myers | 4/560.1 |
| 5,533,638 | A | * | 7/1996 | Robbins, III | 220/8 |
| 5,608,925 | A | * | 3/1997 | Porter | 4/480 |
| 5,655,233 | A | * | 8/1997 | Lackey, Jr. | 4/661 |
| 7,080,418 | B2 | * | 7/2006 | Henegar | 5/86.1 |
| 2005/0273920 | A1 | * | 12/2005 | Marinas | 4/480 |

OTHER PUBLICATIONS

International Search Report; International Applicaion No. PCT/US2010/029926; International Filing Date: Apr. 5, 2010; Mailing Date: Jun. 1, 2010; 3 pages.

Written Opinion of the International Searching Authority; International Applicaion No. PCT/US2010/029926; International Filing Date: Apr. 5, 2010; Mailing Date: Jun. 1, 2010; 5 pages.

* cited by examiner

*Primary Examiner* — Lori Baker
(74) *Attorney, Agent, or Firm* — Guy Levi; The IP Law Firm of Guy Levi

(57) ABSTRACT

A commode seat for a rollator, incorporating therein a collapsible telescopic splash guard.

10 Claims, 4 Drawing Sheets

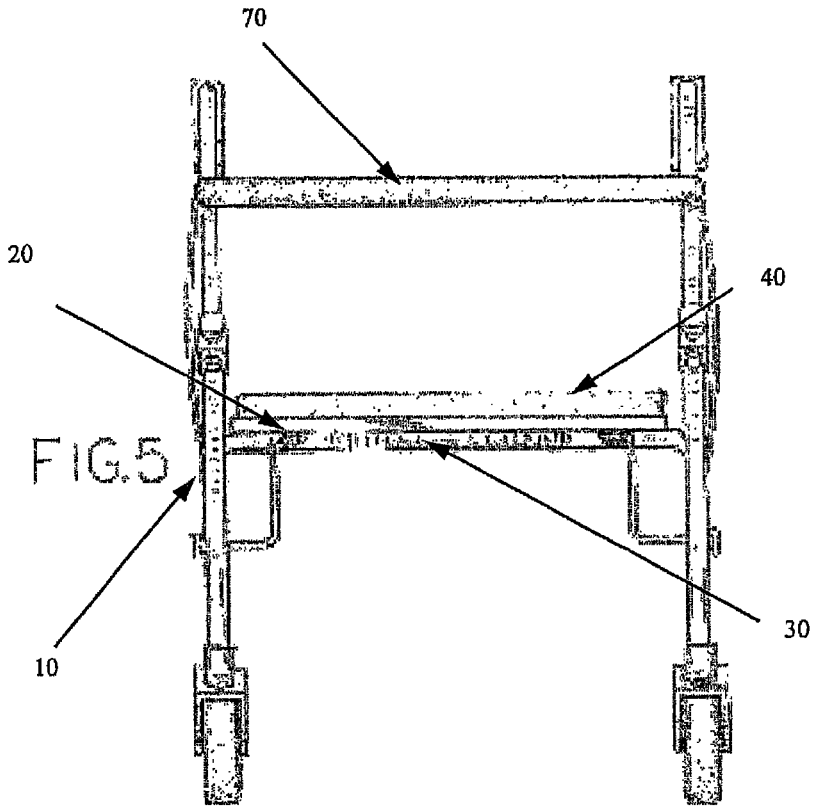
FIG.5
FIG.6
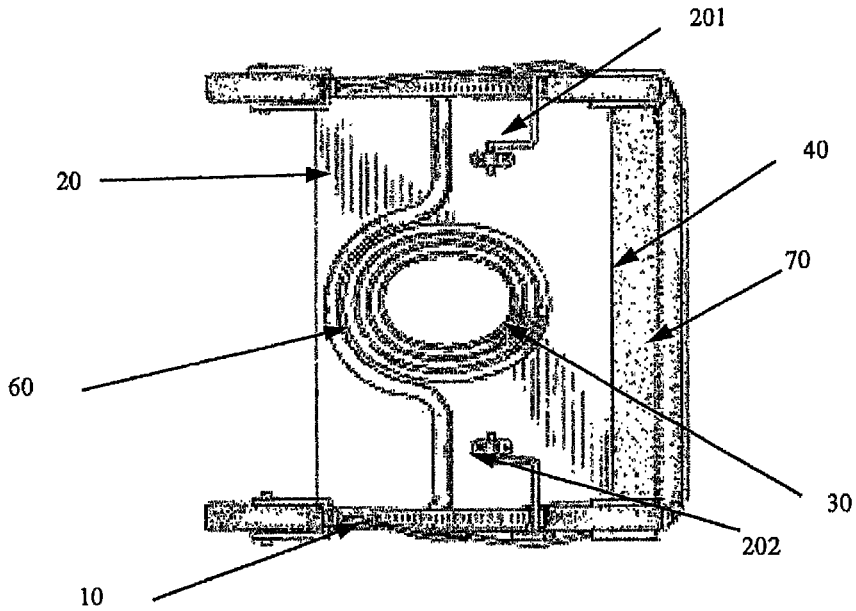

COMMODE SEAT FOR A ROLLATOR

CROSS REFERENCE TO RELATED APPLICATIONS

This application is a National Stage Application claiming priority to U.S. Application No. PCT/US2010/029926, filed on Apr. 5, 2010, which claims priority to U.S. Provisional Application No. 61/168,065 filed on Apr. 9, 2009, and all the benefits accruing therefrom under 35 U.S.C. §119, the contents of both, which are incorporated herein by reference in their entirety.

BACKGROUND OF THE INVENTION

Projections for the aging population show that there will be 70 people million over the age of 65 in the United States by 2030, 30 million over the age of 65 in Japan by 2013, and the E. U., an increase from the current statistics of 85 million to 150 million in 2060. Currently, there are over 6.8 million Americans living outside of institutions and use assistive devices to help them with mobility, of which approximately 1.8 million use walkers.

Slips and falls are the leading cause of mortality and morbidity in people 65 and over, with most falls occurring in the bathroom. One potential cause is that adults 70 and over lose an average of 40% of their upper body strength used to lift themselves up and away from a sitting position. This loss in strength is exacerbated when considering the strength necessary to rise from a squatting position when on the toilet. To prevent accidents in the home, many aging and mobility impaired people require a walking aid, bath/shower chair and other fixtures and a commode or raised toilet seat.

The health care industry has developed aids for those who suffer from such conditions, including crutches, walkers, rollators, and wheelchairs. Rollators are wheeled supports which aid individuals who have function in their lower limbs, but lack the muscular control, strength or balance to enable them to walk unassisted for any substantial period. It is advantageous for such supports to include at least two pairs of wheels in order to avoid the need to lift the device, and to facilitate its use as an ambulatory aid. Further, these devices may include a seat so that a user may use the device to sit and rest.

While government legislation such as the Americans With Disabilities Act (ADA) mandates that public areas provide accessibility to the handicapped and mobility impaired, this primarily focuses on those in wheelchairs (meaning those with very little or no mobility). Unfortunately, the requirements for an ADA-compliant restroom do not facilitate those with reduced mobility (i.e., difficulty sitting and lifting from a seated or squatting position, physically weak and unstable). For example, ADA-compliant toilets range in height from 16"-18" from the floor, as well as, albeit uncommon; a height of 19" in certain circumstances. Additionally, the placement of the grab bars in an ADA-compliant restroom can create more obstacles for those with reduced mobility. In certain circumstances, those individuals with impaired or reduced mobility retrofit their home toilet seat to be set at a minimum of 20" height to eliminate the need for rising from a squatting position that require an exorbitant amount of strength and balance from those individuals. The same additional height will ostensibly be needed in public facilities.

Accordingly, there is a need for a rollator incorporating a commode seat, which is height adjustable and substantially splash free.

BRIEF SUMMARY OF THE INVENTION

The invention is directed to a commode seat capable of being attached to a rollator. Specifically, the invention is directed to a concealed commode seat incorporating therein a retractable telescopic splash guard.

In one embodiment, the invention provides a Rollator with a commode seat which includes a four (4) wheel folding rolling walker ("rollator") with padded seat, wherein the padded seat lifts to expose a concealed commode seat, incorporating therein a collapsible telescopic splash guard, thereby providing a user with additional height and support when using a standard toilet.

In another aspect, the invention provides a commode seat capable of being attached to a rollator, the seat comprises a substantially flat plate having a top surface and a bottom surface defining an oval volume therethrough; and a collapsible splash guard, said collapsible splash guard comprising a plurality of telescoping oval members each radially extending completely around the partial volume of said plate oval volume, with said plurality of telescoping oval members adapted to form a substantially liquid-tight seal upon telescopic extension by friction-fitting said plurality of telescoping oval members together, with one of said plurality of telescoping components being hingedly attached radially to said substantially flat plate to form an impervious junction between said substantially flat plate and said one of said plurality of telescoping oval members, wherein when extended beyond the bottom surface of said substantially flat plate, of said plurality of telescoping components provide a frusto conical splash guard.

Further features and advantages of the present invention, as well as the structure and operation of various embodiments of the present invention, are described in detail below with reference to the accompanying drawings.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways without departure from the scope of the invention provided herein. Likewise, it is to be understood that the phraseology and terminology employed herein are for the purpose of the description and should not be regarded as limiting.

An object of the invention is to provide a Rollator with a concealed Commode Seat for the aging and mobility impaired to safely and hygienically use the toilet away from home.

Another object is to provide a Rollator with a commode seat, which allows the user to safely use a public or private standard toilet at a safe and appropriate height.

Another object is to provide a Rollator with a commode seat, wherein the frame of the rollator prevents restroom slips and falls and other accidents that often occur with the aging and mobility impaired.

Another object is to provide a Rollator with a commode seat, which is discrete.

Another object is to provide a Rollator with a commode seat, which is easy to use.

Another object is to provide a Rollator with a commode seat, which combines these two (2) assistive features into one product, thus reducing the number of aids needed for travel.

Another object is to provide a Rollator with a commode seat, which promotes independence for the user.

Other objectives and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 5 shows front view of a rollator (10) comprising the commode plate (20), the telescoping members (30), a padded seat (40) and a padded cross bar (70);

FIG. 6 shows a bottom view of a rollator (10) comprising the commode plate (20), hinges for the commode seat (201, 202), the telescoping members retracted (30), a padded seat (40) and a fitted cross support member (60)

DETAILED DESCRIPTION OF THE INVENTION

Overview

Figure 1:
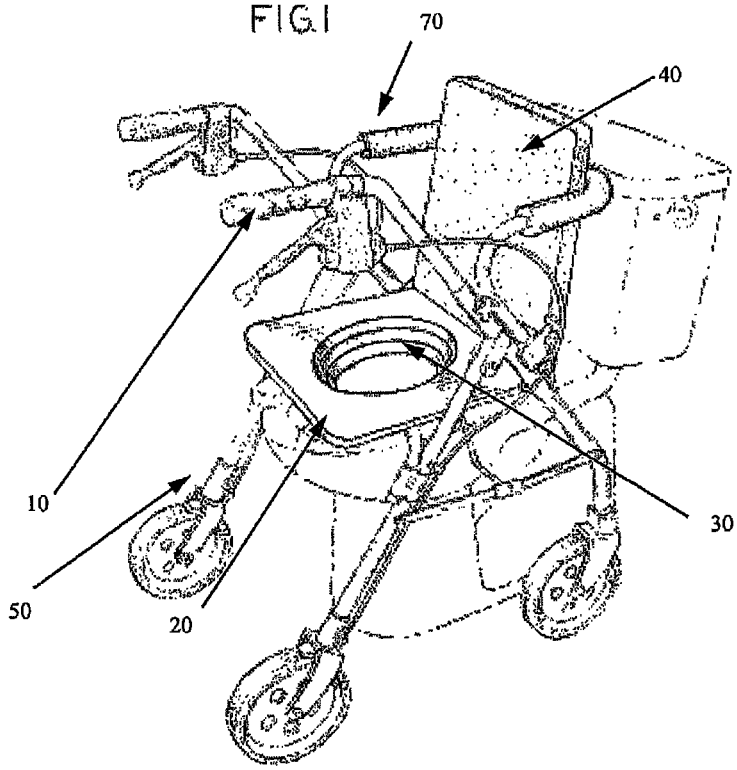
FIG. 1 shows a perspective view of an embodiment of a rollator (10) comprising the commode plate (20), the telescoping members (30), a padded seat (40) and height adjustable wheels (50)

Turning now descriptively to the drawings, in which similar reference characters denote similar elements throughout the several views, the figures illustrate a four (4) wheel folding rolling walker ("rollator") with padded seat. The padded seat lifts to expose another seat which is used for toileting purposes. The purpose of the rollator with the commode seat is to provide the user with additional height and support when using a standard toilet.

Turning now to FIG. 1, showing a perspective view of an embodiment of a rollator (10) comprising the commode plate (20), the telescoping members (30), a padded seat (40) and height adjustable wheels (50). In one aspect, the frame structure of the four (4) wheel rollator (10) consists of two (2) side frames connected by at least one cross-bar assembly (60). The frame supports four (4) wheels, two (2) of which are caster-mounted and pivot. In certain aspects, the frame structure also supports grip handles, push lever break assemblies, and backrest (70).

The "rollator" is an assistive device for people with mobility impairments, either as a result of aging, surgery, accident and/or illness. The rollator enables the user to walk with the support of a sturdy frame and, therefore, is helpful in preventing accidents or further damage to one's health. A padded seat is affixed to the frame and allows the user to sit when tired or at a height greater than some furniture. The frame structure of the rollator enables the user to sit and rise safely with the support of the frame structure close to the body, thereby reducing strain on the body.

The rollator is convenient as it can be folded for packing, storing and transporting. The frame structure of the rollator must be made of a resilient material that can support one's weight, but also be light enough for packing, storing and transporting. The frame structure is made of a tubular metal-type product, and must be resistant to rust and corrosion, such as powdered coated or anodized aluminum, however, other suitable materials may also be available for use. In certain embodiment, the frame is tubular or may have an oval axial cross section.

In certain aspects, the hand grips located at the top of the frame structure are ergonomically-designed or straight. The grip itself is made in certain embodiments of a non-slip material, such as rubber. In one aspect, the frame structure allows the user to adjust the height of the handles by incorporating a telescoping feature on the frame itself, thereby allowing the user to determine the best height for his stature.

Each of the hand grips one certain aspects of the rollator (10) provided herein, has a braking lever directly beneath. This safety feature allows the user control over speed, positioning, and preventing the rollator from rolling. The break lever is controlled through a cable running down the side of the frame structure and coordinating with the rear wheels attached at the bottom rear of the frame structure. The tubular product used in one aspect for the frame structure is also used for the cross bars (60) under the seat, as well as the back rest (70). As previously stated, the product used for the frame structure must be able to withstand one's weight and still remain lightweight. The rollator contains four (4) wheels, two in the front and two in the rear. The front wheels are a caster-mounted, pivotal type wheel to allow for maneuverability of the rollator (10); the rear wheels are not castor-mounted and do not pivot and are associated with the braking system.

The rollator (10) frame structure is a folding, symmetrical and interconnecting frame (10). The frame structure is allowed to fold with the inclusion of two foldable rods, one on each side of the frame. The foldable rods are connected at the front and rear legs of the frame. With the inclusion of these folding rods, the rollator can be folded for packing, storing and travel purposes.

Figure 2:
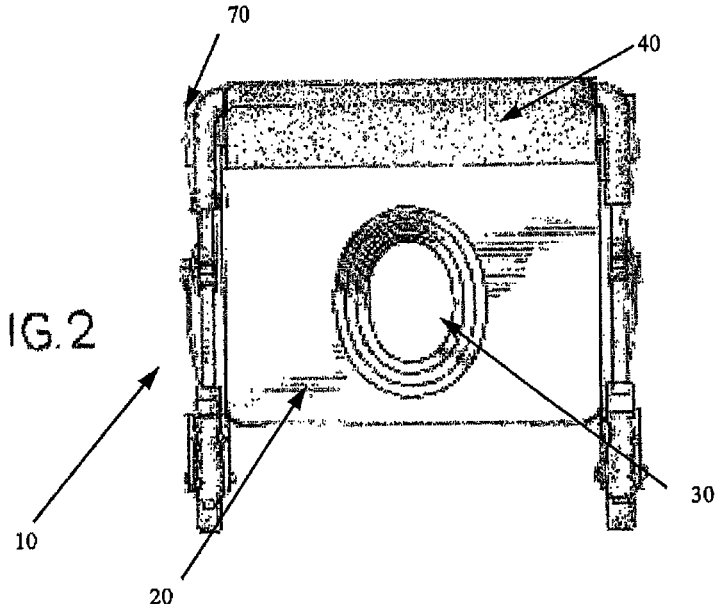
FIG. 2 shows a top view of an embodiment of a rollator revealing the commode seat plate (20), the retracted telescoping members (30) and the padded seat lifted to form a back rest.
Figure 3:
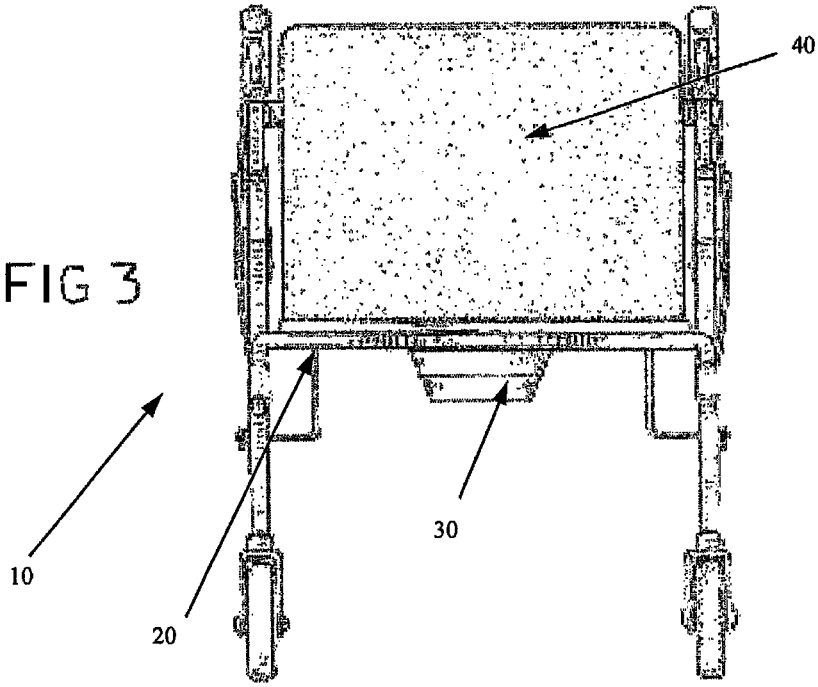
FIG. 3 shows a rear view of an embodiment of a rollator revealing the commode seat plate (20), the extended telescoping members (30) and the padded seat lifted to form a back rest.

Turning now to FIGS. 1, 2 and 3, cross bars (60 and 70) welded to the frame structure provide reinforcement, as well as support for the seating. As shown, the rollator padded seat (40) can be lifted to expose the commode seat (20) and allow the user to position the rollator (10) over the toilet bowl such that the splash guard (30) is located above the bowl. Once over the bowl, the splash guard, comprising a plurality of telescoping oval members each radially extending completely around the partial volume of said plate oval volume, with said plurality of telescoping oval members adapted to form a substantially liquid-tight seal upon telescopic extension by friction-fitting said plurality of telescoping oval members together, with one of said plurality of telescoping components being hingedly attached radially to said substantially flat plate to form an impervious junction between said substantially flat plate and said one of said plurality of telescoping oval members, can be opened to allow the telescoping member to extend directly above the bowl, creating a wide mouthed frusto-conical funnel. Paper disposable splash guards can then be affixed to the funnel, eliminating the need for cleaning the retractable telescoping members at the end of use.

A padded seat (40) is attached to the frame structure with a hinge-type feature on the front side of the frame, as illustrated in FIG. 2 of the drawings. The hinge-type feature allows the user to lift the padded seat for the purpose of exposing the commode seat (20) and creating a backrest when both sides of the seat (40) are padded.

Figure 4:
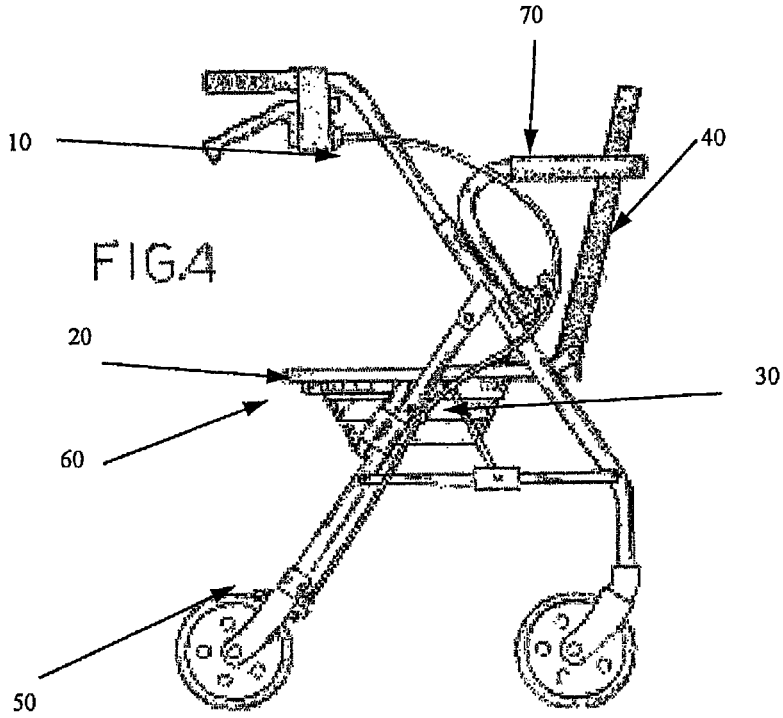
FIG. 4 shows a side view of a rollator (10) comprising the commode plate (20), the telescoping members (30), a padded seat (40) and height adjustable wheels (50)

As shown in FIGS. 4 and 6, another cross bar (70) is attached to the front of the frame structure at a higher level. In one aspect, the bar (70) is wrapped in a cushion-like material and serves as a backrest for the user. In another aspect, a U, or omega (Ω) shaped cross bar (60) is provided, that is shaped to accommodate the splash guard while providing support to the frame of the rollator.

Commode Seat

Figure 7:
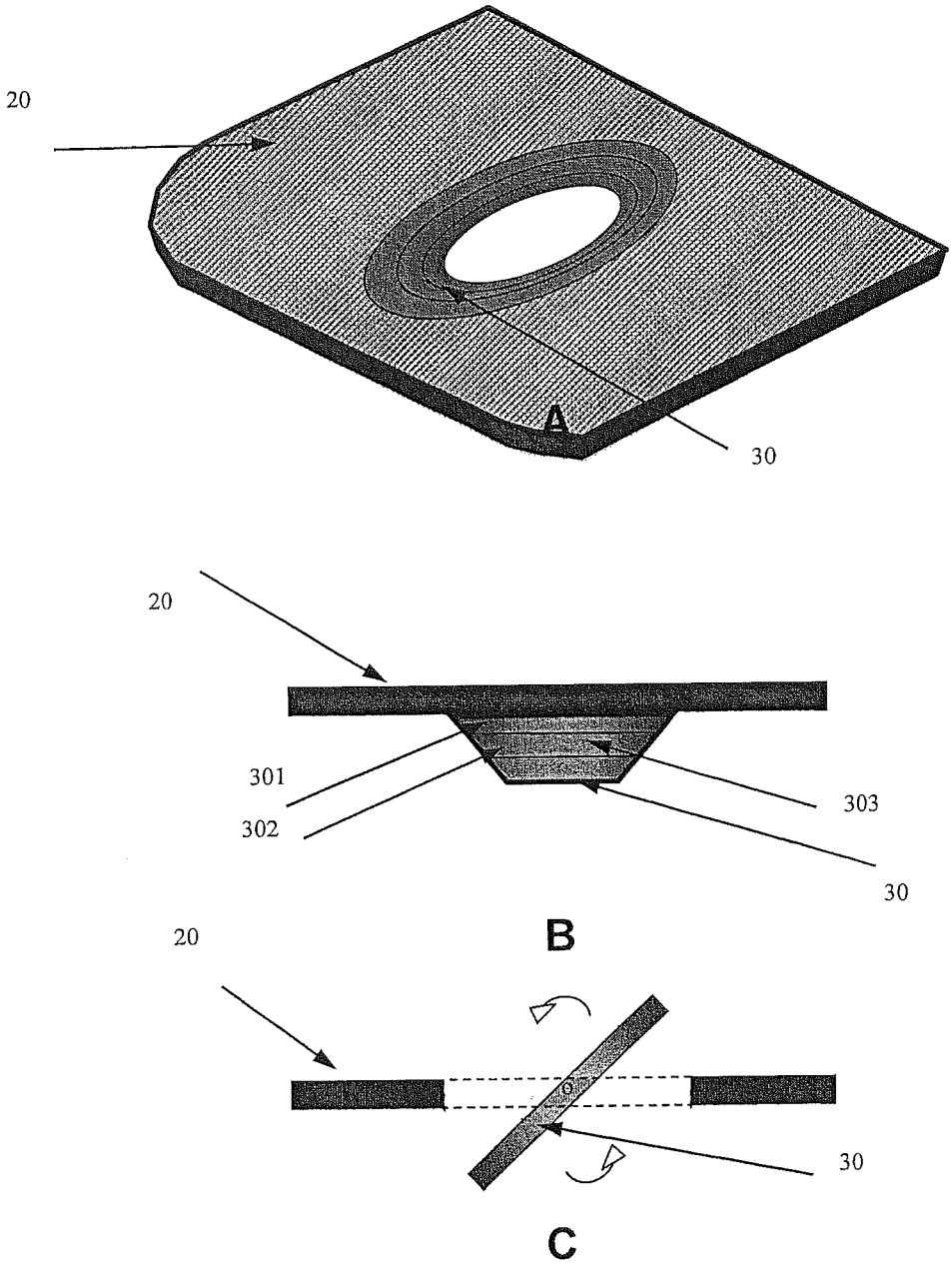
FIG. 7 shows an embodiment of the a.) commode seat according to the invention, the seat (20) comprises a substantially flat plate having a top surface and a bottom surface defining an oval volume therethrough; and a collapsible splash guard, (30); b.) the collapsible splash guard (30) comprising a plurality of telescoping oval members (301, 302, 303); and c.) one of the telescoping components (301) being hingedly attached radially to the plate (20).

Turning now to FIG. 7, the seat (20) is attached to the frame structure of the rollator (10). This seat (20), a substantially flat plate having a top surface and a bottom surface defining an oval volume therethrough, comprising a plurality of telescoping oval members (301, 302, 303) each radially extending completely around the partial volume of said plate oval volume, with said plurality of telescoping oval members adapted to form a substantially liquid-tight seal upon telescopic extension (See e.g. FIG. 1, 3, 4, 7*b*) by friction-fitting said plurality of telescoping oval members together, with one of said plurality of telescoping components being hingedly attached radially (See e.g. FIG. 7*c*) to said substantially flat plate to form an impervious junction between said substantially flat plate and said one of said plurality of telescoping oval members. In certain aspects, the splash guard is removable for cleaning.

Commode chairs and raised toilet seats are assistive devices for people with mobility impairments, either as a result of aging, surgery, accident and/or illness. The products are bulky and are not suitable for travel or use away from the home. Standard height and ADA-compliant toilets are oftentimes too low for those with reduced mobility, which makes it very difficult for them to use the toilet away from their own home and where they use such assistive devices.

The collapsible splash guard is equipped in certain aspects with a locking means that allows the user to lock the telescoping members in either a retracted or extended position. These means include but are not limited to a latch, or a hook, a magnet, a pressure elasticity members consisting of steel balls and springs therebetween them, embedded in the outermost oval telescopic member aligned to fit through holes in the oval volume's periphery and compress into reciprocating grooves in the plate's oval volume, or their combination, each a discrete aspect of the locking means provided herein. In certain aspects of the commode seat provided herein, locking of the telescoping members is unnecessary when extended.

In one aspect, the axial height of the plurality of telescoping oval members (301, 302, 303), when fully retracted is substantially identical to the axial height of the oval volume (30) defined by the opening in the top and bottom surfaces of the substantially flat plate making the commode seat (20).

By incorporating the "commode seat" into the frame of the rollator, this will enable the user the confidently know he/she can use the toilet at the required height anywhere, anytime. Accordingly and in one aspect, provided herein is a rollator comprising the commode seat described herein.

Turning again to FIG. 6. To use the commode seat, the user engages the support bar (60) directly under the commode seat (20). This will allow the user to lift the padded seat (40) to expose the commode seat (20) directly underneath. The padded seat (40) is lifted and becomes a backrest. There is a central opening (30) in the commode seat (20) and is used for toileting. The commode seat (20) is hingedly attached to the rollator frame structure, but can be easily removed for cleaning. In another aspect, the plurality of telescoping oval members (301, 302, 303), when fully retracted extends beyond the bottom surface of the substantially flat plate comprising the commode seat (20).

In one aspect, a lever on the padded seat (40) enables the user to lift the padded seat (40) to expose the commode seat (20) underneath, as illustrated in FIG. 4 of the drawings. The commode seat (20), can be either flat or molded, is affixed to the frame structure directly beneath the padded seat (40) and attached to the frame structure in at least two (2) locations (23), as illustrated in FIG. 4 of drawings. The commode seat (20) can be removed from the frame structure for cleaning.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

What is claimed:

1. A rollator comprising: a commode seat capable of being attached to the rollator, the seat comprises a substantially flat plate having a top surface and a bottom surface defining an oval volume therethrough, wherein the commode seat is configured to be positioned above a toilet bowl at a height greater than a toilet bowl seat and wherein the height of the rollator's wheel is adjustable; a collapsible splash guard, said collapsible splash guard comprising a plurality of telescoping oval members each radially extending completely around the partial volume of said plate oval volume, with said plurality of telescoping oval members adapted to form a substantially liquid-tight seal upon telescopic extension by friction-fitting said plurality of telescoping oval members together, with one of said plurality of telescoping components being hingedly attached radially to said substantially flat plate to form an impervious junction between said substantially flat plate and said one of said plurality of telescoping oval members, the splash guard configured to extend below the bottom surface of said substantially flat plate and into the bowl, said plurality of telescoping components define a frusto conical splash guard; a padded seat with padding on both an upper surface of said seat and an opposite lower surface of said seat, hingedly attached to the rollator frame, concealing the commode seat and configured to provide a backrest; and an Omega-shaped cross support member disposed under the seat, adjusted to accommodate the fully extended telescoping oval members of the splash guard.

2. The seat of claim 1, wherein the top surface of the substantially flat plate is padded.

3. The seat of claim 1, wherein the axial height of the plurality of telescoping oval members, when fully retracted is substantially identical to the axial height of the oval volume defined by the opening in the top and bottom surfaces of the substantially flat plate.

4. The seat of claim 1, wherein the plurality of telescoping oval members, when fully extended, extend beyond the bottom surface of the substantially flat plate.

5. The seat of claim 1, wherein said plurality of telescoping oval members adapted to form a substantially liquid-tight seal upon telescopic extension by friction-fitting said plurality of telescoping oval members together, further comprise locking means to lock the telescopic oval members in a retracted or extended position.

6. The seat of claim 5, wherein the locking means is a latch, a hook, a magnet, a pressure elasticity members consisting of steel balls and springs therebetween them, embedded in the outermost oval telescopic member aligned to fit through holes in the oval volume's periphery and compress into reciprocating grooves in the plate's oval volume.

7. The rollator of claim 1, further comprising a U-shaped or Omega-shaped cross support member disposed under the seat, adjusted to accommodate the fully extended telescoping oval members.

8. The commode of claim 1, wherein plurality of telescoping oval members are removable.

9. The commode of claim 1, wherein the commode seat capable of being attached to a rollator is removable.

10. The rollator of claim 1, wherein the commode seat is configured to be positioned above a toilet bowl.

* * * * *